US005144975A

United States Patent [19]

Polis

[11] Patent Number: 5,144,975

[45] Date of Patent: Sep. 8, 1992

[54] AUTOMATIC ANTIFREEZE BACK-UP VALVE FOR SEWER

[76] Inventor: Morris Polis, 1028 Rosemary La., South Bend, Ind. 46617

[21] Appl. No.: 805,471

[22] Filed: Dec. 10, 1991

[51] Int. Cl.[5] ..... E03B 1/12

[52] U.S. Cl. ..... 137/392; 137/624.12; 137/624.13

[58] Field of Search ..... 137/624.11, 624.12, 137/624.13, 624.15, 392, 386

[56] References Cited

U.S. PATENT DOCUMENTS 3,202,165 8/1965 Yavicoli ..... 137/115 X
3,675,248 7/1972 Gaj ..... 137/115 X
4,272,640 6/1981 Baumbach ..... 137/110
4,392,128 7/1983 Young ..... 137/557 X
4,624,280 11/1986 De Pirro ..... 137/392

*Primary Examiner*—Alan Cohan
*Attorney, Agent, or Firm*—James D. Hall

[57] ABSTRACT

A back-up butterfly valve installed in a sewer pipe which will automatically close when sewage water back flows due to heavy rains thereby preventing sewage-laden liquids in the lower levels of residential homes and commercial buildings. The valve is motor actuated and is controlled by a liquid sensor disposed downstream. A clock is utilized to actuate a system by which the valve is opened and closed periodically preventing the valve from sticking or freezing which would leave the valve inoperative.

6 Claims, 2 Drawing Sheets

AUTOMATIC ANTIFREEZE BACK-UP VALVE FOR SEWER

FIELD OF THE INVENTION

This invention relates to a device for preventing the back-up of sewage water usually resulting from heavy rains in sewer lines. The backing up of the sewage water in these lines can cause deposits of sewage-laden liquids in the lower levels of residential homes and commercial buildings. Previous inventions utilize an automatic valve installed in the sewer line interconnecting the building and street sewer which will automatically close and open in response to flow conditions in the sewer pipe with the valve automatically closing during flood or backup conditions due to a float operated switch structure with the valve being normally open during normal gravity flow conditions. U.S. Pat. No. 3,202,165 issued to Yavicoli on Aug. 24, 1965 relates to an automatic sewer backup valve wherein a sensor responds to blockage of a sewer line by causing a float operated switch to activate a valve closing the sewer line and a signal light indicating a blockage. U.S. Pat. No. 4,272,640 issued to Baumbach on Jun. 9, 1981 also discloses such an automatic sewage valve with wiper seals for cleaning the gates on the valve and a sewage pump.

Yet, these inventions do not employ a device that prevents the valves and related parts from sticking or freezing which would prohibit the valve from opening and closing in response to a sewage backup. Further, float operated switches are sometimes costly and unreliable due to the multiple parts and leakage in the float itself.

SUMMARY OF THE INVENTION

The present invention utilizes a timer to activate a system by which the valve is opened and closed periodically to prevent it from freezing. Also, a more reliable liquid sensor is used instead of float devices to activate the valve when sewage water back-flow reaches a certain level in the connecting lines.

It is an object of this invention to provide a device for preventing the freezing of a valve mechanism that seals sewer lines against the backing up of sewage water.

It is another object of this invention to provide a more reliable valve to prevent the backup of sewage water.

Another object of this invention is to provide a more reliable and economical valve activation device.

A further object of this invention is to provide an alarm system indicating that the valve is closed due to sewage water backup.

Other objects will become apparent upon a reading of the following description.

DESCRIPTION OF THE PREFERRED EMBODIMENT

The preferred embodiments herein described are not intended to be exhaustive or to limit the invention to the precise forms disclosed. It is chosen and described to explain the principles of the invention and its application and practical use so that others skilled in the art may follow its teachings.

For purposes of understanding the operation of invention, wires connecting the elements will be numerically described and the terminals on the electrical devices will be numerically labeled.

Figure 2:
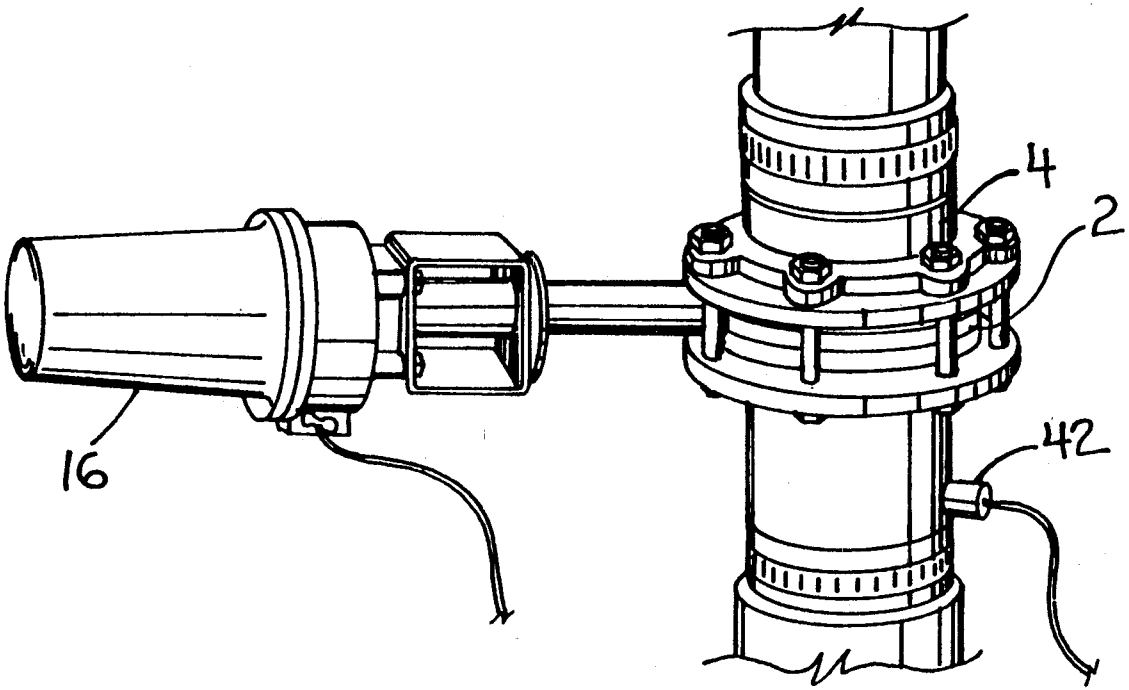
FIG. 2 is a fragmentary perspective view of a sewer pipe with the automatic sewage backup valve, sensor, and motor attached.

Referring to FIG. 2 the valve device is preferably a butterfly valve 2 fitted into the sewer pipe 6 by a suitable coupling 4 in a manner well within the skill of the art.

A 12 v DC torque actuator 16 is connected to the valve 2 such that when the motor 18 is actuated in one direction, the valve disc 20 will be pivoted into its closed position and when the motor 18 is operated in the reverse direction the valve disc 20 will be pivoted into its open position.

Figure 1:
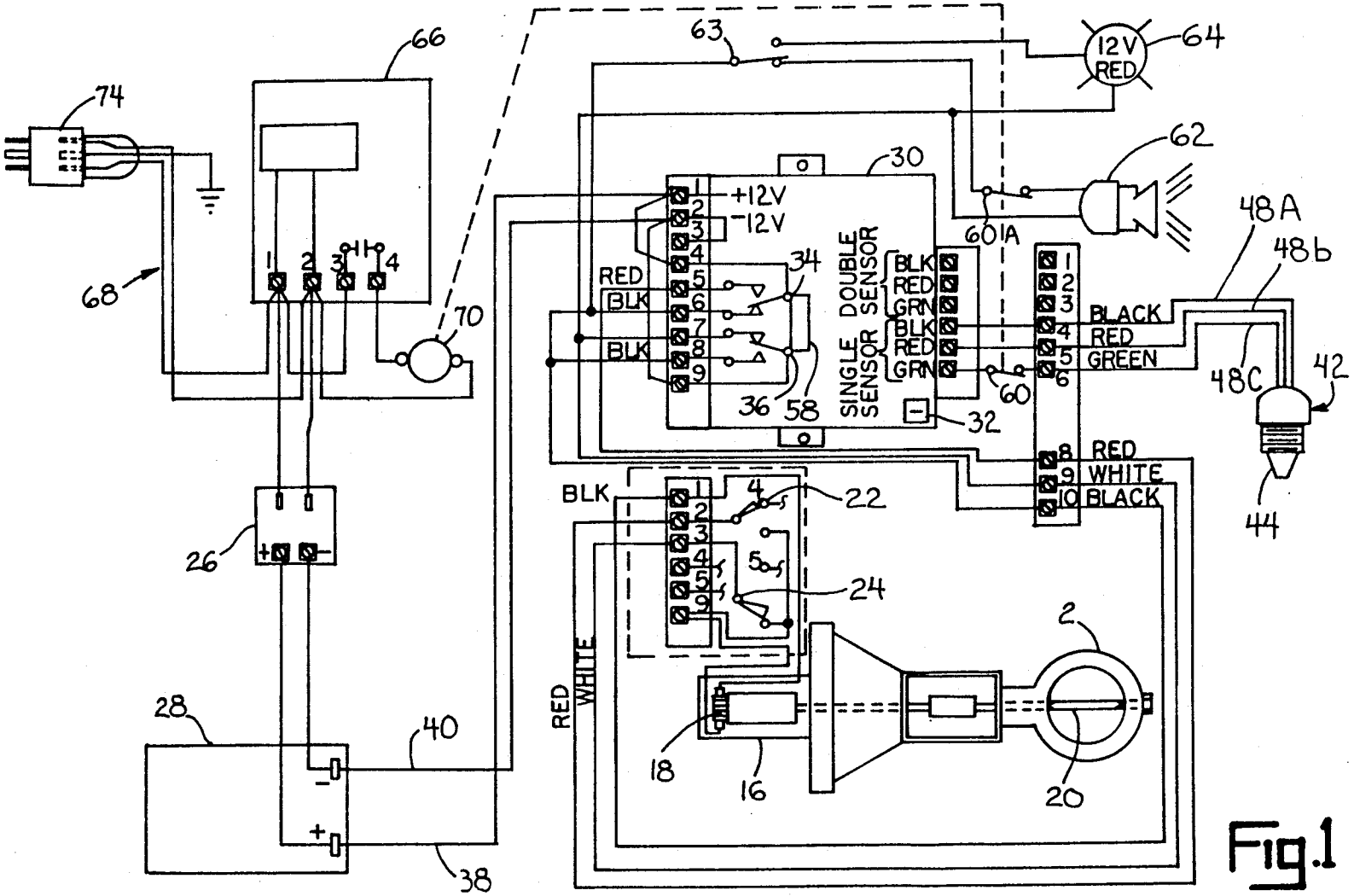
FIG. 1 is a representative circuit diagram showing the control system for the back-up valve.

FIG. 1 illustrates the circuit diagram connected to the back-up valve. All devices are drawn in the de-energized state with relay 58 energizing as soon as power is applied and the level is not up to sensor tip 44.

The wiring diagram for the torque actuator is shown in FIG. 1. The circuit contains two single pole double throw limit switches 22 and 24 that are cam actuated by the rotation of the motor. These switches will open or close to move the valve 2 in the open or the closed positions. These switches allow the circuit of the controller in one polarity to close the valve as long as the sensor is immersed in liquid. Likewise the switches permit the controller to enable the circuit that opens the valve with the opposite polarity as long as the sensor is dry. These switches are connected respectively by four wires 5–8 to a Levelite 11-512 controller manufactured by Bindicator Co.

For supplying power to the controller 30, an AC house current 68 travelling through a surge suppressor 74 is converted into a 12 volt DC voltage with a current of 50 milli-amps by step down transformer 26 to charge the power supply battery 28. All power to the controller 30 and the actuator motor 18 is provided by the battery 28 with the transformer 26 maintaining the charge rate keeping the battery charged. The controller includes a switch 32 so that either a single or a dual point liquid level sensor may be utilized. Controller 30 also includes within its circuitry an adjustable internal time delay and a variable sensitivity setting. Contacts 34 and 36 of a double-pole, double throw insulated relay 58 are connected to the positive and negative voltage input pins respectively of the controller 30. The positive voltage line 38 from the DC battery 28 is connected to input pins 1 and 4 of the controller 30. The negative voltage line 40 from the DC battery 28 is connected to input pins 2 and 9 of the controller. An electric generator may also be substituted in place of the battery and step-down transformer.

A Levelite 12-502A series connected probe 42 used as the liquid level sensor is of common known construction having a quartz contact tip 44. Probe 42 is threaded into the user's sewer pipe with tip 44 positioned interiorly within the pipe at a location indicative of the maximum allowed level of sewage water within the pipe as shown in FIG. 2. Voltage from the controller 30 to the probe is pulsed 5 v DC, eliminating the need for a conduit.

Probe 42 is connected by wires 48*a, b, c* connected to the series controller 30. The probe operates optically. A beam of infrared light generated inside the probe is directed down the quartz tip 44. If the probe tip 44 is immersed in a sewage water, the light will be refracted into the water. If the probe tip 44 is not immersed, it will act as a prism to reflect light back to an optical sensor within the probe activating the logic circuitry which energizes the relay 58 in the controller 30.

A contact 60 which is enabled by relay 70 connects the sensor 42 to the controller 30 via wire 48*c*.

An audio alarm 62 is optionally included. The positive terminal of the alarm 62 is connected to terminal 7 and the negative terminal of the alarm 62 is connected to terminal 6 of the controller 30. Also included in this option is an alarm silence switch 63 and a light 64. When the relay 58 of the controller 30 is de-energized by the rising liquid contacting the probe in the sewer pipe, an alarm 62 will sound announcing that the valve 2 has closed. The alarm can be silenced by activating switch 63. Operation of the switch 63 will turn on light 64 indicating that the valve 2 is closed. When the liquid in the sewer pipe recedes the relay 58 of the controller 30 will energize and open the circuit of the light 64 or the alarm 62 deactivating them.

A digital clock EZ-701-1 (66) manufactured by EZ Controls is connected to the house current and is used to periodically cycle the valve to assure operation under actual conditions. A two pole double throw relay 70 is enabled by the clock 66 at selected periods of time such as every seven or 30 days.

In normal operation without a sewer water backup situation, the valve 2 is in its open position allowing the sewage water to flow freely. The circuitry in the liquid sensor is closed activating the logical circuitry in the controller 30 that creates the switch configuration of the relay contact of the controller. The relay 58 enables the contact 34 to break the positive DC line and wire 6 connection and make the positive DC line and wire 5 connection. In other words, contact 34 closes the positive DC line and wire 5 circuit and opens the positive DC line and wire 6 circuit. Similarly, the relay 58 enables contact 36 to close the negative DC line and wire 8 circuit and open the negative DC line and wire 7 circuit. The positive and negative lines from the battery 28 are connected to the DC motor 18 by the contacts in the controller 30 and the limit switches 22 and 24. The valve is in its open position.

When the sewage water counter flows creating a backup situation in that the sewage level contacts the quartz tip 44, a situation is created disenabling current from the sensor 42 to controller 30. This open circuit deactivates the logical circuitry that controls the relay 58, causing relay 58 to de-energize. This allows contact 34 to operate breaking the positive DC line with line 5 and energize line 6. At the same contact 36 operates and breaks the negative DC line with line 8 and energize line 7. This will make terminal 1 on the actuator positive and terminal 3 negative. This circuit supplies voltage of opposite polarity from that of normal operation to the motor 18 causing the valve 2 to close. The audio alarm 62 also sounds. Current will flow through the motor by limit contact 24 until opened by the cam at the closed position. Shortly after the motion is initiated, limit contact 22 will close to allow the motor to reverse direction closing the valve if the controller supplies voltage through contact 22 upon the sewage level falling below the level of the sensor. The controller will maintain the polarity on terminals 1 and 3 of the actuator and contact configuration until the level at the sensor recedes.

When the level recedes, the current from the sensor will enable the logic in the controller and the relay 58 will energize. Contact 34 will operate and connect line 5 to the positive DC line and break the connection between line 6 and the positive DC line. At the same time contact 36 will operate and connect line 8 to the negative DC line and break the connection between line 7 and the negative DC line. This will make terminal 1 on the actuator negative and terminal 2 positive. Hence, the voltage polarity on the motor 18 is reversed opening the valve 2. Current flows through the motor by limit contact 22 until opened by the cam at the open position. Shortly after motion is initiated, limit contact 24 will close allowing the motor to reverse direction to open the valve if the controller supplies voltage through contact 24 when a backup situation is present. This operates contact 34 to break the positive DC line and wire 5 connection and make the positive DC line and wire 6 connection. In other words, the contact closes the circuit for that line 1 and wire 6 and opens the circuit for that line and wire 5. Likewise, the relay triggers 58 contact 36 to close the circuit for negative and 7 and opens the negative DC line 2 and 8.

The clock 66 at selected periods will supply a cycle having start and stop pulses that enable the relay 70 on the start pulse and disenables the relay on the stop pulse. Relay 70 opens and closes the contact 60 which in turn simulates the liquid sensor. When the relay 70 is enabled, contact 60 is opened and simulates to the controller 30 that the level in the sewer pipe has risen to the sensor tip 44. This deactivates the logic circuitry that de-energizes the relay 58 allowing voltage of the polarity to actuate the motor to close the valve. At this time, relay 70 opens contact 60*a* and disenables the audio alarm 62 by breaking the circuit from controller 30 preventing the alarm from sounding, since the sewage has not actually risen to create a back up situation. After the situation. After the programmed time has lapsed, the relay 70 will be disabled by the stop pulse and contact 60 will close and reconnect the sensor 42 to the controller 30, activating the logic circuitry that energizes the relay that allows voltage of opposite polarity to actuate the motor in the reverse direction to reopen the valve. The contact 60*a* will also close and reconnect the alarm 62 to the controller 30.

It is understood that the above description does not limit the invention to the given details, but may be modified within the scope of the following claims.

I claim:

1. In a valve device for controlling back-up flow in a sewer line, said device comprising a valve means for including a valve part mounted for movement between a closed position and an open position, means for automatically moving said valve part into said closed position in response to a sewer back-up flow, timing means for automatically opening and closing said valve part periodically absence the back-up flow.

2. The invention of claim 1 wherein said means for automatically moving said valve part includes a drive means for activating said valve part, said drive means is a reversible motor.

3. The invention in claim 2 wherein said means for automatically moving the valve part includes a liquid probe with a quartz tip adapted for mounting in the sewer line, said liquid probe operatively associated with said reversible motor to cause activation of the motor to move said valve into said closed position when sewage flow within said sewer line approaches the level of said tip due to back flow conditions.

4. The invention in claim 1 wherein said valve part is a butterfly valve.

5. The invention of claim 2 wherein said timing means activates a switch means for actuating said motor to open and close said valve part.

6. The invention of claim 5 wherein said timing means is a digital clock.

* * * * *